United States Patent [19]

Puccini et al.

[11] 4,135,840

[45] Jan. 23, 1979

[54] TOOLS FOR IMPRINTING NON-REPEATING STONE PATTERNS IN FRESH CONCRETE

[76] Inventors: John L. Puccini, 432 Upper Lake Rd., Thousand Oaks, Calif. 91360; Edward F. Shea, Jr., 2855 E. Wastach Ct., Westlake Village, Calif. 91361

[21] Appl. No.: 881,699

[22] Filed: Feb. 27, 1978

[51] Int. Cl.[2] ..... E01C 23/16

[52] U.S. Cl. ..... 404/93; 404/89; 404/124

[58] Field of Search ..... 404/124, 122, 121, 93, 404/89; 156/219; 264/293

[56] References Cited

U.S. PATENT DOCUMENTS

| | | | |
|---|---|---|---|
| 397,731 | 2/1889 | Laird | 404/124 |
| 519,919 | 5/1894 | Maurer | 404/124 |
| 1,063,752 | 6/1913 | Walling | 404/93 |
| 1,099,185 | 6/1914 | Loveland | 404/124 |
| 3,220,369 | 11/1965 | Gandrud | 404/124 X |
| 3,832,079 | 8/1974 | Moorhead | 404/124 X |

*Primary Examiner*—Nile C. Byers, Jr.

[57] ABSTRACT

The present invention is a tool for forming a non-repeating design in fresh concrete. The tool has a plurality of blades forming a non-repeating stone pattern. The perimeter of all interior stone patterns are closed and/or defined, while all exterior patterns are open and only partially defined. The open blade ends of the open patterns are equally spaced about the perimeter of the tool, so that it will align with an adjacent open blade end of a second tool or an imprint and complete a stone pattern in any position and create a non-repeating design. The tool may also be used to create a random repeating pattern by successive non-rotational alignment of all open blade end of any particular side.

7 Claims, 12 Drawing Figures

Fig. 1
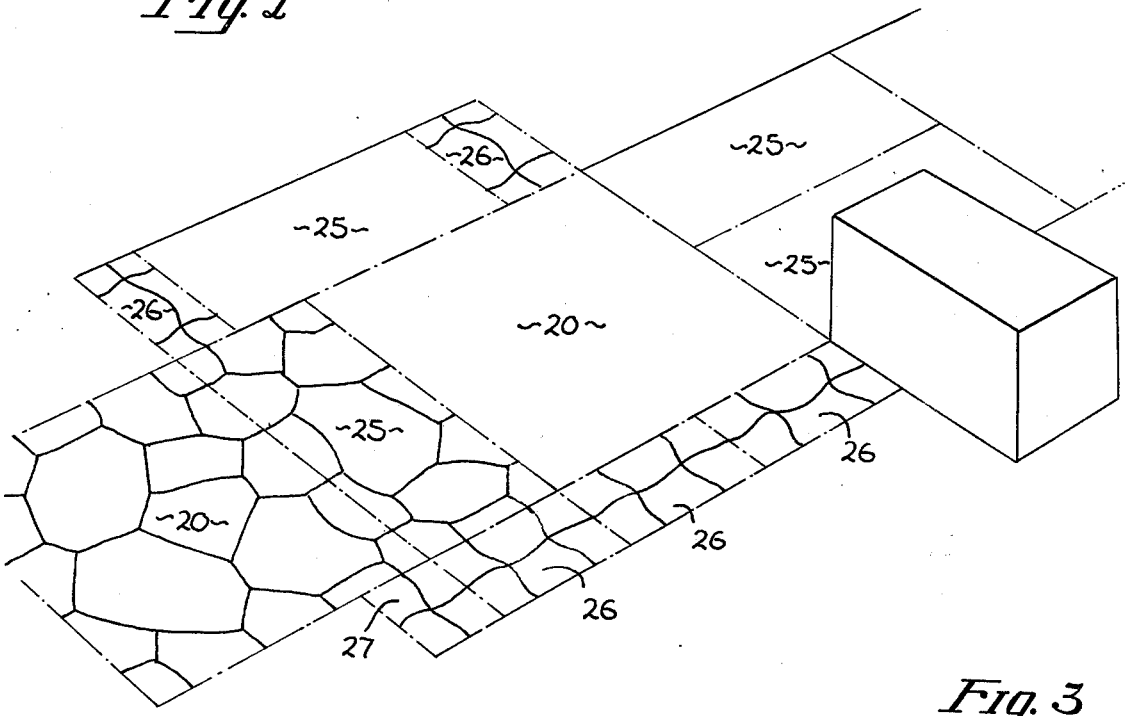
Fig. 3
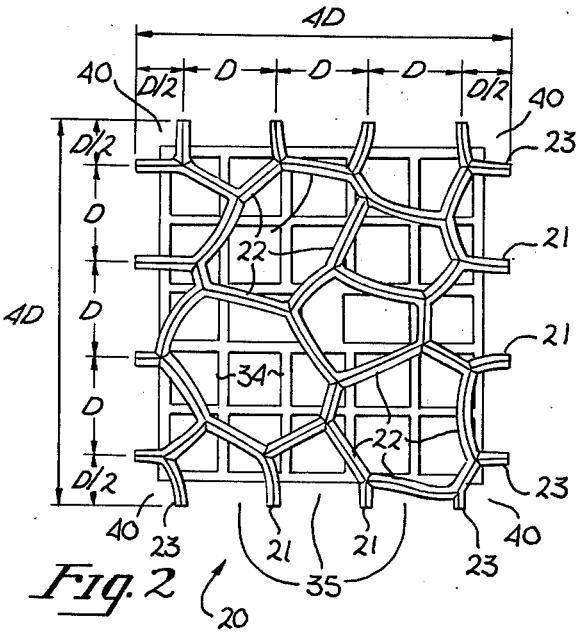
Fig. 2
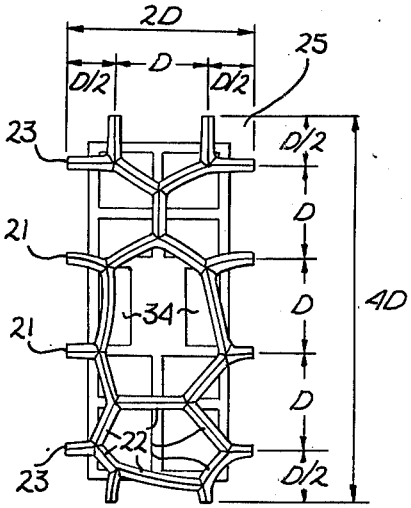
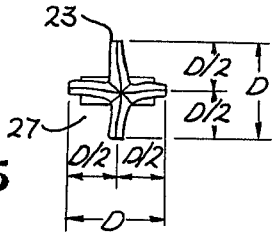
Fig. 5
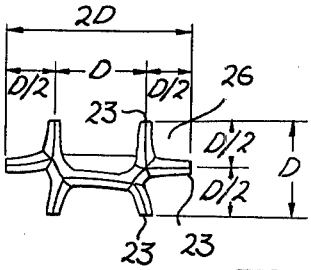
Fig. 4

TOOLS FOR IMPRINTING NON-REPEATING STONE PATTERNS IN FRESH CONCRETE

BACKGROUND OF THE INVENTION

1. Field of the Invention

The present invention relates to tools for imprinting stone patterns in fresh concrete, and particularly to creating non-repeating stone patterns.

2. Prior Art

Imprinting designs in concrete in the form of stones, bricks, tiles or cobblestones is known in the prior art. The prior art devices basically comprise the use of two different and unique tools. The first such application is U.S. Pat. No. 3,406,618, filed Oct. 22, 1968, Bradshaw Bowman. The second is U.S. Pat. No. 3,930,740, filed Oct. 17, 1974, also by Bradshaw Bowman. These two separate Patent Applications are separate and distinct, describing one tool which provides for stamping of a uniform pattern, while the second, describes a tool for creating non-repeating patterns.

U.S. Pat. No. 3,406,618 describes the tool for forming the repeating pattern. That Patent teaches a tool having a plurality of blades formed into the particular shape desired, i.e., in the particular case described, it is in the shape of bricks. The tool described in that invention must be used to create a uniform pattern of imprints in the placed concrete. The tool is described and claimed as having two closed sides and one open side. In use, the closed side is aligned with a particular edge of the slab and the pattern is stamped. The tool is then lifted and must be aligned with the edges and also with the newly created imprint. Alignment is acomplished by placing the open ends adjacent to where the closed ends had just been imprinted. In this manner, the new open end must be in registry with the corresponding closed edge or imprint of the adjacent pattern. A more accurate alignment will result if several tools are used and aligned at the same time. Many particular problems exist with the use of this tool and particular problems exist for doing non-rectangular or modular slabs of concrete. The tool cannot be used to do small areas or irregular shaped areas. The tool must be placed in proper vertical and horizontal alignment with adjacent tool or imprint, in order to form the identical repeating pattern. The patent discusses the use of this tool for the imprinting of various stone patterns. However, its use must be restricted to repetitive patterns. The alignment features described permit only alignment of the opened ends with the closed ends. The particular tool could not be used to create non-repeating random stone patterns. The tool must have alignment. The actual usage of such tool, chalk lines, straight edges, are required in the placement and use of that tool. Such procedures are extremely expensive and time consuming and greatly increase the cost of use of that particular tool.

U.S. Pat. No. 3,930,740 is the tool for imprinting non-repeating stone patterns. The tool described in that patent can best be described as a crow foot. It has three intersecting blades, meeting or joining at a common point. That tool is used by being placed in random points throughout the concrete to be imprinted. The non-repeating pattern is created because of the random placement of the imprints of the crow foot. A separate tool is then used to cut a separate line joining the various intersections or imprints left by the random imprinting. The particular tool does create non-repeating, random stone patterns. The tool is undesirable because it still requires a skilled workman to imprint all of the lines between the various extensions of the crow foot and to create the random non-repeating pattern after the imprints have been stamped. This type of work is expensive because of the great amount of labor involved in forming the various lines between the formed imprints. It also requires a trained workman to create a desirable random pattern of tool imprints. The size, placement and design of any particular work will be different than any other particular job. Hence, the aesthetic or cosmetic effect may vary substantially from one job to the other, depending upon the degree of skill of the workman.

Other tools are known in the prior art which have not been patented but are known. A typical tool is generally rectangular in shape, having the interior formed to imprint a stone pattern. Some of these tools have even formed the tool to create a few partial edge stone patterns, such that any adjoining tool will partially complete that particular partial stone pattern. These tools are an improvement on the prior art, but all have one element in common; a closed perimeter. In use, the defined perimeter creates a visual grid pattern, detracting from the natural stone design. This particular tool also requires precise alignment in each direction to properly complete the adjoining partial stone pattern. The tool does not permit the creation of a non-repeating pattern and the finished works shows clearly a particular grid work which significantly distracts from the cosmetic appearance of the total design. There are no tools, known or taught, by any prior art, which have completely open perimeters for creating a non-repeating random design of stone patterns in concrete. All prior art devices are very expensive because of the labor involved in their use which is the one thing that imprinting is attempting to avoid, i.e. the cost of placement of brick, cobblestones, or other stones, in lieu of concrete. The present invention solves these problems by providing a tool which economically, and efficiently creates a non-repeating stone pattern in fresh concrete. The tool can be used by any other unskilled workman and creates a very cosmetic pleasing appearance which can be predicted for each usage.

SUMMARY OF THE INVENTION

A tool for forming a non-repeating stone pattern in fresh concrete is disclosed. The tool is comprised of a plurality of blades arranged in a predetermined random pattern. The interior stone patterns are completely defined while all exterior (edge) patterns are open or only partially defined. The blade ends of the random open edge patterns are spaced apart a specific distance so as to be able to communicate with the blade end of any adjacent open edge pattern of any adjacent tool or imprint. The non-repeating pattern is created by repeated imprinting of the tool as it is rotated in any direction on a first tool or imprint.

It is an object of the invention to provide a tool for forming non-repeating stone patterns in fresh concrete which need not be aligned with any item except an adjacent tool or imprint.

It is another object of the present invention to provide a tool which aligns with any adjacent tool or imprint in any position, rotation, or configuration. It is another object of the invention to provide a tool which can be used to create a consistent, predictable, cosmetic appearance for any concrete to be imprinted.

It is another object of the present invention to provide a tool which will permit the imprinting of stone patterns in concrete by unskilled workman in a rapid and economical manner.

It is another object of the present invention to systematically form a non-repeating pattern in any irregular, rectangular concrete slab without the need of manual, fill-in work.

BRIEF DESCRIPTION OF THE DRAWINGS

FIG. 1 is a perspective view of a workman utilizing the present invention to form a non-repeating random stone pattern in an irregular concrete slab;

FIG. 2 is an elevation view of the preferred form of the cutting blades of the tool of the present invention;

FIG. 3 is an elevation view of the second tool of the preferred form of the present invention;

FIG. 4 is the third tool of the preferred form of the present invention;

FIG. 5 is the fourth tool of the preferred form of the present invention;

DETAILED DESCRIPTION OF THE INVENTION

The present invention is a tool for inscribing non-repeating random designs of stone patterns in concrete. The tool of the present invention could be formed in many different shapes or patterns. Two particular designs are described in this patent application, it being understood that the concepts of the present invention could be applied to many other shapes and configurations.

Figure 6:
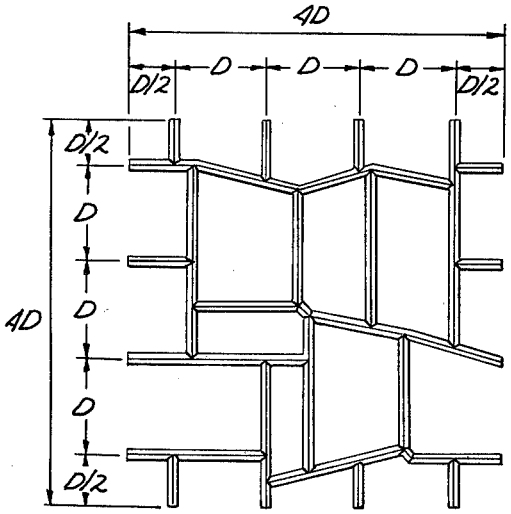
FIG. 6 is an elevation view of an alternate embodiment of the first tool of the present invention.
Figure 7:
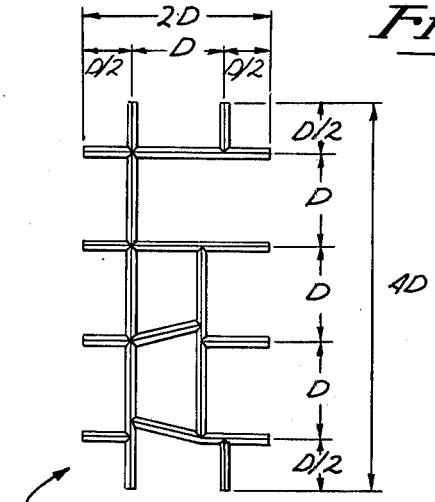
FIG. 7 is an alternate embodiment of the second tool of the preferred form of the present invention.
Figure 10:
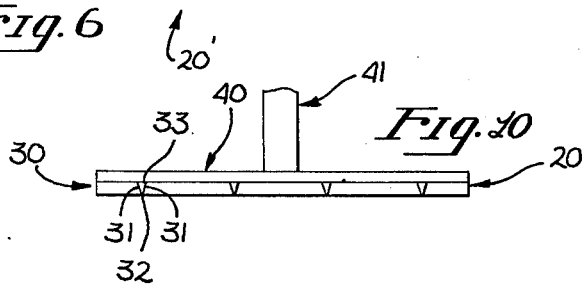
FIG. 10 is a side view of the preferred form of the present invention.
Figure 8:
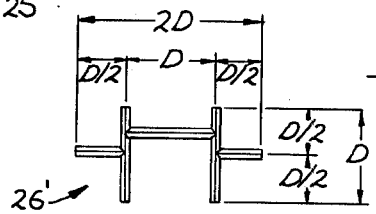
FIG. 8 is an alternate embodiment of the third tool of the preferred form of the present invention.
Figure 9:
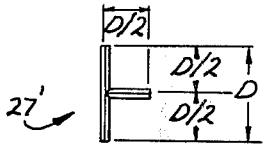
FIG. 9 is an alternate embodiment of the fourth tool of the preferred form of the present invention.

Referring first, to FIG. 1, a workman is shown imprinting an irregular concrete slab with the tools of the preferred form of the present invention. The tools, 20, 25, 26 and 27, are the preferred form and are illustrated in plan view in FIGS. 2, 3, 4, and 5, respectively. A side elevation view of the tool of FIG. 2, is illustrated in FIG. 10. The tool of the present invention can take several different sizes, as illustrated in FIGS. 2, 3, 4, and 5. Each of those various tools can be used either separately or in conjunction with any other tool in that set. Each tool in that set is adapted for particular uses, as shown in FIG. 1, however, it is also understood that the entire slab in FIG. 1 could be formed by using any one of the tools illustrated in FIGS. 1, 2, 3, 4, and 5. The tool 20, of the present invention can be best described in reference to FIGS. 2 and 10. The blades referred to collectively as 30, in FIG. 10, are formed to define various stone patterns. A particular stone pattern, having a random irregular effect, is shown in FIGS. 2, 3, 4, and 5. Each individual blade 30, is triangular in cross-section, having a pointed bottom 32, sides 31, and a flat top portion 33. All interior blades referred to generally as 22, FIG. 2, are completely enclosed to define a particular shape of a stone pattern (the blade 22, forming the perimeter outline of each particular stone). All exterior partially defined stone patterns 35, form the edge or perimeter of the tool 20. The blades referred to generally as 21, define the partial perimeter of the partial stone patterns referred to collectively as 35. Thus, if a single tool 20, were imprinted in concrete, the pattern left would be that of a multiple series of stone patterns 34, completely defined within the interior of the tool with a plurality of only partially defined stone patterns 35, forming the perimeter.

The present invention is so designed that the tool 20, of the present invention can be rotated into any position such that any perimeter blade 21, when brought in alignment with an adjacent blade 21, or imprint, will automatically align itself with all other adjacent perimeter partially defined patterns 35. This ease of alignment and placement is of utmost significance, for it greatly reduces the time for forming the stone pattern and reduces significantly the cost because of that reduced time. It also permits the use of the particular tools to imprint the stone pattern in irregular slabs of concrete. As can be seen from FIG. 1, when tool 20, is rotated into any position to align with itself or another tool, a different design of stone patterns will be created. This is partly because of the random design of the various exterior blades 21. Although the present invention does not produce a design of a true random selection of stone patterns, it produces a design so close that it is impossible to tell that a single tool was used to produce the design or effect. When used properly, no seam lines exist and the alignment of the various end blades 21, does in fact, produce a truely totally non-repeating pattern in any direction.

Of particular importance is that the design can be simultaneously began at various points with alignment. This is extremely beneficial when large areas are to be imprinted, because several crews can begin work with different tools from different starting points and not have to worry about alignment problems.

The tool 20, can be rotated upon itself and placed in any position to align with itself because of the perimeter design and positioning of the exterior blades 21. Referring to FIG. 2, it can be seen that every perimeter blade labeled 21, is spaced a distance of D from any other exterior blade 21, the corner blades designated generally as 23, are spaced a distance of D/2 from the theoretical corner and are spaced a distance of D from any adjacent blade 21. This particular relationship permits the proper positioning of the tool in any position in which any blades 21 or 23, are in alignment with any other imprint or blade so as to complete any adjacent pattern 35 is formed of a non-repeating pattern.

FIG. 3 represents the second tool of the series of the preferred form of the present invention. This tool is basically a tool similar to tool 1, FIG. 2, excepting that it is one-half of the size. In addition, the interior patterns 34, are of different shapes and sizes as those illustrated in FIG. 2. The external blades 21 and 23, are however, spaced exactly the same distance apart from one another as the blades 21 and 23 are spaced apart in FIG. 2. This smaller tool 25, is used to create the imprinted patterns in smaller areas, as illustrated in FIG. 1. FIG. 4 of the present invention illustrates the third tool of the preferred form of the present invention. This tool, as the tool illustrated in FIGS. 2 and 3, is used to create the random stone pattern effect illustrated in FIG. 1. This particular the tool 26, is used to form the non-repeating pattern in smaller areas as illustrated in FIG. 1. This tool, as the tool 2, FIG. 3, will automatically align with any perimeter or external end blade 21 or 23, of tool 1 or 2, to form and complete the partially formed stone pattern 35.

FIG. 5 illustrates the fourth tool of the preferred form of the present invention. This tool, as the previously described tools do, can be used to complete the stone patterns in smaller areas as illustrated in FIG. 1. The blades 23, are spaced apart a distance similar to the modular distance of the previously described tools, so that the joining of any one end 23, to any other blade 21 or 23, will complete that particular partially defined stone pattern 35.

A completely unskilled person may use the tools of the previously described invention and form a non-repeating pattern of stones in a concrete slab very rapidly and efficently. The various sized tools are particularly accommodating for various size of jobs. In operation, a worker would place any one tool in the concrete in any desired position. After the blades are pressed into the concrete a sufficient distance, another tool could be aligned in any position with that particular original imprinted pattern to form and extend that pattern. A worker, by simply picking up, placing, and replacing either one or multiple tools, can complete any size of project without the use of chalk marks, alignments and need not be skilled. This presents a significant savings to any contractor because of the ease of operation and rapidity of completion.

The blades of the present invention are normally secured to a grid pattern 40, illustrated in FIGS. 10 and 2. The grid pattern 40, in the preferred form, is cast integral with blades 30, and presents a platform unto which the workman may walk and thereby press the blades into the freshly poured concrete. Often a handle 41, will be secured to the grid pattern 40, to permit ease of handling and also to serve as a striking post for pressing the blades referred to generally as 30, and to the fresh concrete.

The first alternate embodiment of the present invention is shown in FIGS. 6, 7, 8, and 9. The internal and exterior design of the blades and stone patterns are completely different than that illustrated in FIGS. 2, 3, 4, and 5, the preferred form of the present invention. However, tools 20', 25', 26', and 27', of the first alternate embodiment are comparable to tools 20, 25, 26, and 27, of the presently preferred form of the invention. In this particular design, illustrated in FIGS. 6, 7, 8, and 9, the distance between the end blades 21 and 23, are exactly the same as the end blades of the presently preferred embodiment. Thus, all of the tools illustrated in FIGS. 6, 7, 8, and 9, will align with themselves when placed in any relationship such that two exterior blades adjoin each other.

In the preferred form of the present invention, the distance D is 6 inches. It has been found that this dimension makes a very handy and usable set of tools for the imprinting of any concrete job whether large or small. The tools as described, are easily handled by the workman and the imprinting is completed in rapid fashion.

It has been found that the present invention can be formed of any heavy duty material, but is preferred to be formed of aluminum or other light material.

Figure 11:
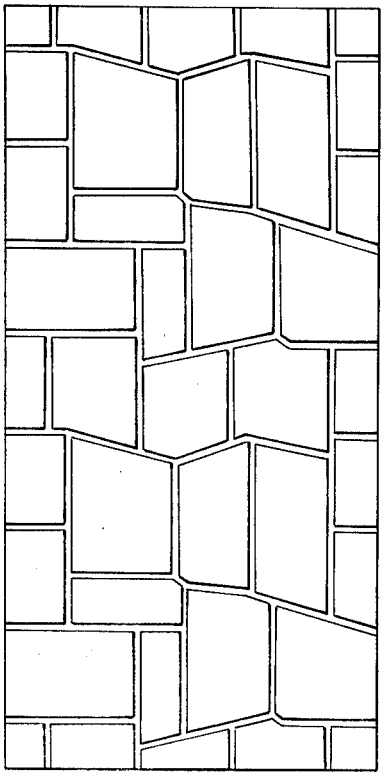
FIG. 11 is a repeating random design of stone patterns in concrete formed by the present tool.
Figure 12:
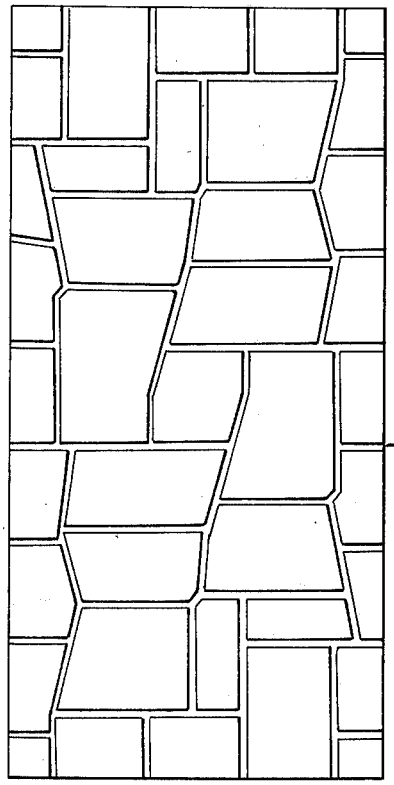
FIG. 12 is a non-repeating random design formed by the tool of the present invention.

The design of completely non-repeating random stone patterns is illustrated in FIG. 12, as being formed by the tool defined in the alternate embodiment of the present invention. It should be noted that a random repeating design can be produced by non-rotation and edge to edge placement of the tool defined in the alternate embodiment. Such a pattern is illustrated in FIG. 11. This pattern is created by successive positioning of the tool in position so that the tool is not rotated, but is lifted successively in complete and consistent alignment with the previously formed pattern.

While only two particular design forms for the blades of the present invention have been disclosed, it is understood that those skilled in the art may make various changes in the form and detail without departing from the spirit and scope of the invention.

I claim:

1. A platform tool for forming non-repeating stone patterns in fresh concrete, said platform tool comprising a plurality of blades, disposed in a single plane in a non-repeating predetermined outline of said stone patterns, said blades;

(a) completely defining the perimeter of all interior stone patterns;

(b) defining only a portion of the perimeter of all exterior stone patterns, the terminating ends of each of said blades forming said exterior stone patterns being spaced an equal distance from each other and one-half of said equal distance from each corner;

whereby said non-repeating design is formed by imprinting a first pattern with said platform tool, creating defined interior patterns and partial defined exterior patterns, said tool is then rotated into any other position, such that any of said terminating end is aligned with any of said imprinted partially defined exterior patterns and imprinted thereby, completely defining said aligned exterior pattern, said complete non-repeating design can be formed in any fresh concrete slab by such repetitive steps of aligning and imprinting.

2. The tool of claim 1, wherein said platform tool can be used to create a repeating irregular design in fresh concrete by repetitive, successive, non-rotational alignment of adjacent imprints formed by said platform tool.

3. The tool of claim 1, wherein said blades form an approximate square, each side having four of said terminating ends for defining approximately one-half of three of said exterior stone said terminating ends, spaced $\frac{1}{4}$ of the length of said side from one another, and spaced $\frac{1}{8}$ of the length of said side from each corner.

4. The platform tool of claim 1, wherein said blades form an approximate rectangle, the longest side being two times longer than the shortest side, said longest side having four of said terminating ends for defining $\frac{1}{2}$ of three of said exterior stone patterns and approximately $\frac{1}{4}$ of two of said exterior stone patterns, said ends spaced $\frac{1}{4}$ of the length of said longest side from one another, and spaced $\frac{1}{8}$ of the length of said longest side from each corner, said shortest side having two of said terminating ends for defining approximately $\frac{1}{2}$ of one of said exterior stone patterns and $\frac{1}{4}$ of two of said exterior stone patterns, said terminating ends being spaced $\frac{1}{8}$ of the length of said longest side from each corner.

5. The tool of claim 1, wherein said blades form an approximate rectangle, the longest side being two times longer than the shortest side, said longest side having two of said terminating ends for defining approximately $\frac{1}{2}$ of one of said exterior stone patterns and approximately $\frac{1}{4}$ of two of said exterior stone patterns, said ends spaced $\frac{1}{4}$ of the length of said longest side from each corner, said shortest side having one of said terminating ends disposed in the middle thereof.

6. The tool of claim 1, wherein said plurality of blades form a pattern of irregular non-repeating stone patterns.

7. In a platform tool for forming stone patterns in fresh concrete, the improvement wherein the blades of said tool are arranged to define irregular non-repeating stone patterns, said tool having its perimeter forming a series of partially defined stone patterns, each of said partially defined stone patterns defined by said blades and being open, each end of each of said blades defining said open pattern, being equally spaced from each adjacent end, and spaced a ½ of said equal distance from each corner, said blades defining the entire perimeter of all interior stone patterns, said tool capable of being aligned with any end of an adjacent tool and imprint by being rotated into any position to form said irregular non-repeating design.

* * * * *